United States Patent [19]

Martin et al.

[11] Patent Number: 4,989,790

[45] Date of Patent: Feb. 5, 1991

[54] NOZZLE CAP, SPRING VALVE AND BODY ASSEMBLY

[75] Inventors: Douglas S. Martin, Forest City, N.C.; Wilhelmus J. J. Maas, Someren, Netherlands

[73] Assignee: AFA Products, Inc., Forest City, N.C.

[21] Appl. No.: 456,634

[22] Filed: Dec. 26, 1989

[51] Int. Cl.[5] ..... B05B 9/043; B05B 1/12

[52] U.S. Cl. ..... 239/483; 239/489; 239/496; 239/497; 239/539

[58] Field of Search ..... 239/333, 476, 477, 478, 239/479, 482, 483, 489, 493, 494, 496, 497, 539

[56] References Cited

U.S. PATENT DOCUMENTS

| | | | |
|---|---|---|---|
| 1,166,340 | 12/1915 | Erickson | 112/80.5 |
| 1,620,209 | 3/1927 | Ihne | 239/497 |
| 1,631,894 | 6/1927 | Schlaepfer | 239/481 |
| 2,378,348 | 6/1945 | Wilmes et al. | 239/491 |
| 2,577,901 | 12/1951 | Marlow | 239/491 |
| 3,061,202 | 10/1962 | Tyler | 239/333 |
| 3,120,348 | 2/1964 | O'Donnell | 239/490 |
| 3,843,030 | 10/1974 | Micallef | 222/554 |
| 4,109,869 | 8/1978 | Brockelsby et al. | 239/333 |
| 4,234,128 | 11/1980 | Quinn et al. | 239/478 |
| 4,247,048 | 1/1981 | Hayes | 239/396 |
| 4,273,290 | 6/1981 | Quinn | 239/333 |
| 4,313,568 | 2/1982 | Shay | 239/333 |
| 4,350,298 | 9/1982 | Tada | 239/333 |
| 4,503,998 | 3/1985 | Martin | 239/333 |
| 4,669,664 | 6/1987 | Garneau | 239/333 |
| 4,678,123 | 7/1987 | Klaeger | 239/464 |
| 4,706,888 | 11/1987 | Dobbs | 239/478 |
| 4,730,775 | 3/1988 | Maas | 239/120 |
| 4,767,060 | 8/1988 | Shay et al. | 239/417 |
| 4,768,717 | 9/1988 | Shay | 239/403 |
| 4,779,803 | 10/1988 | Corsette | 239/428.5 |

FOREIGN PATENT DOCUMENTS

| | | |
|---|---|---|
| 60-18306 | 9/1985 | Japan . |
| 63-69579 | 5/1988 | Japan . |

*Primary Examiner*—Andres Kashnikow
*Assistant Examiner*—Karen B. Merritt
*Attorney, Agent, or Firm*—Thomas R. Vigil

[57] ABSTRACT

The nozzle cap, spring valve and body assembly for a trigger sprayer comprises a nozzle cap, a spring valve and a body. The nozzle cap is capable of being screwed upon the nose bushing portion of the body. The nozzle cap has an outlet orifice located in its front face and a sleeve extending rearwardly from a front wall thereof. The sleeve is threaded inside the rear portion thereof and has an internally contoured surface on a short annular formation that is located forwardly of the threads on the back side of the front wall to provide an inner annular surface and an outer annular surface rearward of an inner wall surface of the nozzle cap and forward of the internal threads inside the sleeve. The nose bushing portion of the body has a cavity in which is received the spring valve. The nozzle cap is screwed upon (threaded on) an externally threaded portion of the nose bushing portion of the body and over the spring valve and is selectively threadably positionable between three selective positions such that the positioning of the inner wall surface of the nozzle cap and the inner and outer annular surfaces of the short annular formation in the nozzle cap selectively cooperate with an outer annular periphery of a face disc of the spring valve having two angular spin-causing grooves in the annular periphery thereof and with the second inner annular surface of the nose bushing portion of the body thereby selectively to provide an OFF mode position for containment of liquid, a spray mode position to discharge liquid in a spray pattern from the outlet orifice, and a stream mode position to discharge liquid in a stream pattern from the outlet orifice.

11 Claims, 7 Drawing Sheets

NOZZLE CAP, SPRING VALVE AND BODY ASSEMBLY

CROSS-REFERENCE TO RELATED APPLICATIONS

This application is a continuation-in-part of U.S. application Ser. No. 07/437,549 filed Nov. 16, 1989 for: ADJUSTABLE NOZZLE ASSEMBLY.

BACKGROUND OF THE INVENTION

1. Field of the Invention

The present invention relates to a nozzle cap, spring valve and body assembly for mounting to a trigger sprayer which is used in dispensing liquid in a spray mode or a jet mode and for containing the liquid in an OFF mode.

2. Description of the Related Art

A variety of simple and inexpensive hand-operated trigger sprayers have been proposed which include means for coupling to a container from which a liquid is to be dispensed under pressure. Such a trigger sprayer includes a trigger which is intended to be moved manually to operate a pump piston within a cylinder in a body of the trigger sprayer, usually against the force of a return spring, so that liquid may be pumped from the container and dispensed through an ejection nozzle or outlet orifice of the trigger sprayer.

To meet consumer demands for convenience it has been found to be highly desirable that the nozzle provide varying discharge patterns such as a conical spray pattern and a stream pattern. It is further preferable that the nozzle assembly not only be able to accommodate a stream mode or conical spray mode of operation in a highly reliable fashion, but that it also conveniently engage into an OFF mode position to contain the liquid in the dispenser to prevent leakage or inadvertent discharge of the liquid and to promote easy storage of the container of liquid with the trigger sprayer mounted thereon by the ultimate consumer.

To minimize cost, the various parts of the prior art trigger sprayers are increasingly made of plastic resins suitable for injection molding. Further, it has been found to be highly desirable that the design of the trigger sprayer be simplified such that the number of separately molded parts are minimized and so that the assembly of the parts may be mechanized at a minimum of cost and with maximum economy.

Heretofore, various designs or configurations of nozzle assemblies have been proposed to provide the above referenced desirable features, particularly the feature that the nozzle assembly be adjustable to provide varying discharge patterns, i.e. a spray pattern and a stream pattern.

Examples of prior art trigger sprayers including an adjustable nozzle cap for selectively dispensing a liquid in a spray mode or stream mode, are disclosed in the following U.S. Pat. Nos.:

| U.S. PAT. NO. | PATENTEE |
|---|---|
| 4,767,060 | Shay et al. |
| 4,706,888 | Dobbs |
| 4,503,998 | Martin |
| 4,350,298 | Tada |
| 4,313,568 | Shay |
| 4,273,290 | Quinn |
| 4,247,048 | Hayes |
| 4,234,128 | Quinn et al. |

-continued

| | |
|---|---|
| 3,843,030 | Micallef |
| JAPANESE PAT. PUBLICATION NOS. | |
| JP60-183061 | |
| JP63-69579 | |

In U.S. Pat. No. 4,767,060 there is disclosed a nozzle assembly which is capable of selectively dispensing a liquid product as a foam or a spray by means of a selectively movable member to establish a swirl chamber located in between, and in liquid communication with, a passageway and a nozzle outlet orifice. Such member can be moved forward into the nozzle cap where it offers no interference with the vertical liquid sheet to effect a spray mode of delivery. The member can be moved rearwardly to a point where the swirl chamber interferes with the vortical sheet to produce a stream pattern. Gas passageways are provided in this structure to achieve aeration of the turbulent fluid and the resultant dispensing of the liquid as a foam.

U.S. Pat. Nos. 4,706,888; 4,234,128; and 3,843,030 disclose nozzle assemblies each including a rotatable nozzle cap mounted for rotation relative to a cylindrical member, with the cap and member having cooperating radial and/or axially extending passageways for creating stream or swirl liquid flow patterns depending upon the particular registration of the cap with the cylindrical member.

In U.S. Pat. No. 4,706,888 there is disclosed a nozzle assembly capable of being opened and closed in selective rotative positions of a nozzle cap of the assembly with respect to two discreet passages and grooves formed between a discharge conduit and a discharge orifice to provide an alternating off, stream and spray position for a liquid dispenser. Such multiple passages in a cylinder and the nozzle cap cooperate to move in and out of alignment and communication thus providing the spray and stream modes of operation depending upon alignment and registry of the various describe passages and grooves. U.S. Pat. No. 4,706,888 alleges the following drawbacks in the devices disclosed in U.S. Pat. Nos. 3,843,030 and 4,234,128:

"For example, U.S. Pat. No. 3,843,030 has its nozzle cap containing an off-centered discharge orifice which must be shifted upon cap rotation between alignment with the spin chamber at the end of an internal probe for producing a spray, and a channel on the probe for producing a stream. The off center location of the discharge orifice not only presents problems for the consumer in properly targeting the discharge, but gives rise to a shearing action during cap rotation in that the inner edge of the discharge orifice must traverse the plug surface containing the spin chamber and associated tangentials which could cause abrasions or snags between the rotating parts resulting in undue wear and leakage . . . The nozzle assembly of U.S. Pat. No. 4,234,128 like-wise requires the spin chamber and associated tangential grooves to be formed on the underside of the cap end wall, and passages and slots on an internal plug arranged to produce a stream or spray discharge or shut-off. Thus, some of the details for the dispense function are on the cap end wall and some others are on the plug confronting this end wall, such that a shearing action results between these details as they pass one another upon cap rotation. Due to such abrasive and interrupted engagement between rotating parts, scoring, snags and/or undue wear occurs with consequent leakage."

With respect to U.S. Pat. No. 3,843,030 it is observed that the tubular extension described therein includes a free end having a staggered recess for cooperation with the cap in producing spray and stream modes of operation.

The Martin U.S. Pat. No. 4,503,998 discloses a nozzle assembly including an elastic cap-shaped member mounted inside a nozzle cap and having swirl directing channels therein, as well as a swirl chamber. The nozzle cap, spring valve and body assembly of the present invention can be advantageously incorporated into the trigger sprayer disclosed in this patent.

The Tada U.S. Pat. No. 4,350,298 discloses a wave plate spring utilized in a spinner assembly including a cylindrical secondary valve having a rounded end which seats against a valve seat in an outlet passageway in a trigger sprayer. A similar wave plate spring is disclosed in JP 60-183061.

The Shay U.S. Pat. No. 4,313,568 discloses a nozzle assembly for a trigger sprayer wherein the nozzle assembly includes a cap-shaped sealing structure and a disc having holes therethrough and having swirl establishing channels and a swirl chamber in a front surface therein mounted adjacent a front inner wall surface in a nozzle cap.

The Quinn U.S. Pat. No. 4,273,290 discloses a unitary valve and spring assembly for use in a trigger sprayer. The S-spring in this assembly has some similarity with the sinuous spring incorporated into the spring valve and of the nozzle assembly of the present invention.

JP 63-69579 discloses a nozzle assembly including a resilient ring-shaped spring and valve member for use in a nozzle assembly attached to a trigger sprayer.

In U.S. Pat. No. 4,247,048 there is disclosed a two-piece nozzle assembly which features a tubular member having a circular, planar face at its terminal end with a recess in the planar face. When a cap having a dispensing orifice is rotatably mounted to the tubular member it has an end wall with a planar inside surface which will form an interface with the circular planar face of the tubular member. The dispensing orifice of the cap is radially displaced from the center axis of the cap which is registerable, when properly aligned, with the recess of the planar face.

SUMMARY OF THE INVENTION

The nozzle cap, spring valve and body assembly of the present invention comprises three parts, suitable for injection molding, namely, a nozzle cap, spring valve, and a body each of which are integral units designed to cooperate with each other in a simplistic, economical and efficient manner. The rotatable nozzle cap includes a front wall and a rearwardly extending skirt having an internally threaded portion so that the nozzle cap can be screwed upon an externally threaded portion of the body. Inside the cap, forwardly of the threads, the back side of the front wall has a specially configured inner wall structure including a short annular formation having an outer annular surface, a rearward inner conical surface, and a forward inner annular surface extending forwardly to an inner wall surface. An orifice extends through the cap front wall from the inner wall surface to a front face of the cap. The inner wall surface can be at least partially frusto-conical.

The body has an annular barrel nose bushing portion at its forward periphery and an inner stepped cavity including a forward cavity portion, an annular shoulder, an inner cylindrical cavity, and a cavity back wall onto which a passageway in the body opens.

The spring valve includes a rear, disc-shaped valve member received in the inner cylindrical cavity against the cavity back wall, a sinuous spring in the inner cavity, extending to a base portion mounted in the cavity against the annular shoulder, a forwardly extending stem portion and a front face disc. The face disc has an outer annular periphery, and a front face which is partially frusto-conical and which is adapted to seat against the inner wall surface of the nozzle cap.

The outer annular periphery has two angular, spin-causing grooves therein to allow passage of liquid from a back side of the face disc.

When the nozzle cap is fully screwed upon the externally threaded portion of the body, the front surface of the spring valve face disc is in flush contact with the inner wall surface of the nozzle cap to provide an OFF mode position for the nozzle cap, spring valve and body assembly to contain liquid within the dispenser. At the same time, the outer annular periphery of the spring valve face disc sealingly engages the forward inner annular wall surface of the short annular formation of the nozzle cap.

As the rotatable nozzle cap is unthreaded from the externally threaded portion of the body, the frusto-conical seating surface of the spring valve face disc is unseated from the frusto-conical inner wall surface of the nozzle cap with the outer annular periphery still sealingly engaging the forward inner annular wall surface. This unseated position of the nozzle cap defines a swirl chamber between the front seating surface of the face disc of the spring valve and the inner wall surface of the nozzle cap. Liquid then passes to and through the angular grooves in the annular outer periphery of the face disc into the swirl chamber in a circular or spinning motion and discharges through the centrally located outlet orifice in the nozzle cap in a conical spray pattern.

When the nozzle cap is further unthreaded from the externally threaded portion of the body, the outer annular periphery of the spring valve face disc is opposite the radially outwardly disposed inner frusto-conical surface such that liquid can now pass around the outer periphery and is not channeled solely through the angular grooves so that the liquid enters the now larger swirl chamber radially inwardly as opposed to angular inwardly in a swirl. As a result, liquid exits the orifice in a stream or jet pattern.

Additional features and advantages of the present invention will become apparent to those skilled in the art from the following description and the accompanying figures illustrating the preferred embodiment of the invention, the same being the present best mode for carrying out the invention.

DESCRIPTION OF THE PREFERRED EMBODIMENT

Figure 1:
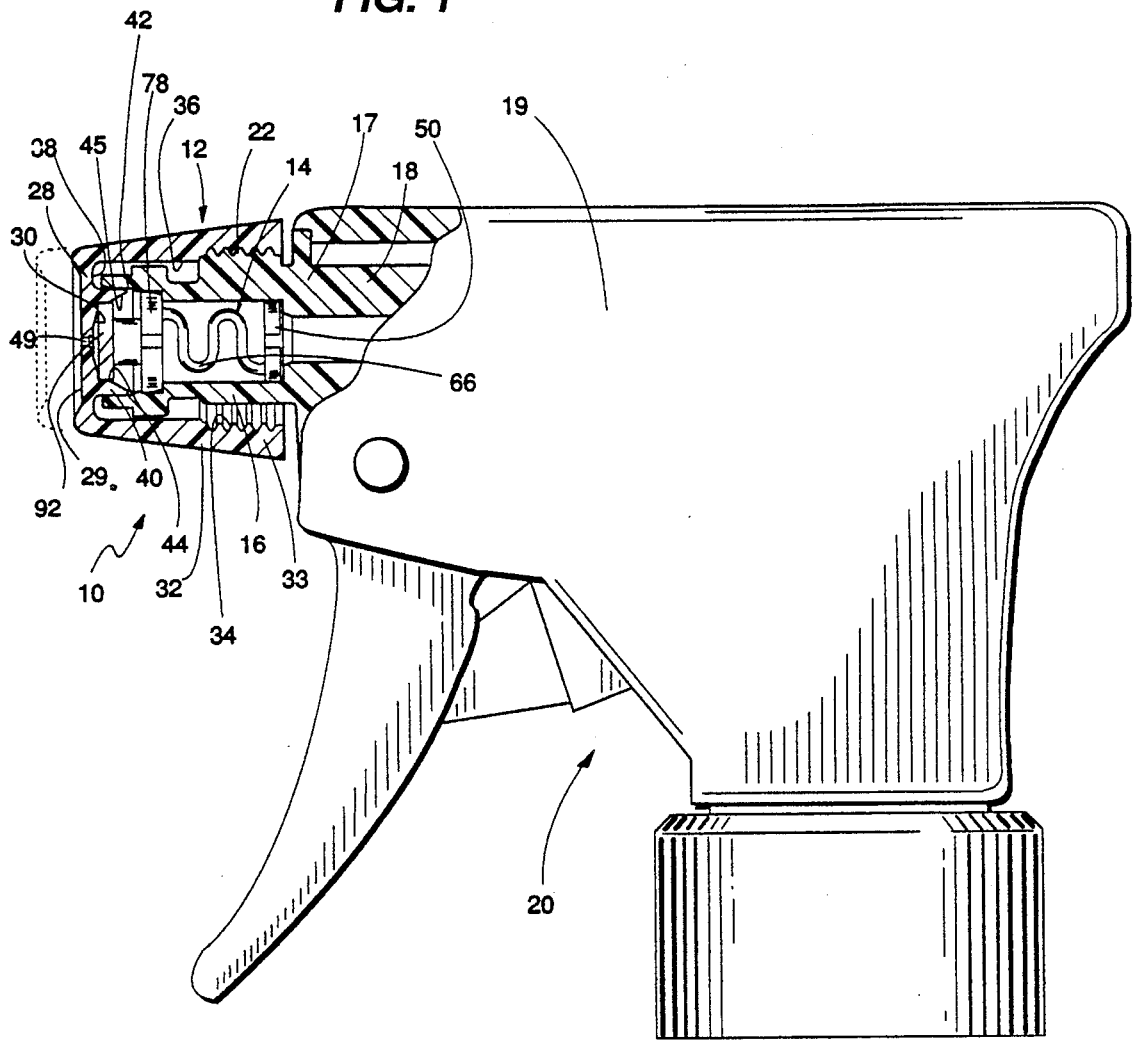
FIG. 1 is a side elevational view of a trigger sprayer with portions broken away from a nozzle cap, spring valve and body assembly constructed according to the teachings of the present invention.

With reference to FIG. 1, a nozzle cap, spring valve and body assembly 10 constructed according to the teachings of the present invention is shown. The assembly 10 comprises three integral parts, namely a nozzle cap 12, a spring valve 14 and a body 19. The nose bushing portion 16 of the body 19 has a base portion 17 which is received in or is a part of, a front end 18 of the body 19 of a trigger sprayer 20 which is adapted to be mounted on a container of liquid (not shown).

As observed in U.S. Pat. No. 4,247,048, a nozzle cap and a nose bushing preferably are made of dissimilar thermoplastic materials such as polypropylene, polyethylene, polyethylene terephthalate, nylon, or ABS Plastic. In this way, the cap and nose bushing are of dissimilar materials with one material being harder than the other to provide high fidelity liquid seals as the harder material will "seat" into the softer material.

The nozzle cap 12 and the spring valve 14 of the assembly 10 are each integral pieces which may be fabricated of different materials by conventional injection molding techniques known to those skilled in the art.

Referring to the drawings in greater detail, there is illustrated in FIG. 1, the nozzle cap 12 mounted on an externally thread portion 22 of the nose bushing portion 16 of the body 19 which is mounted to or integral with the trigger sprayer 20.

The nozzle cap 12 includes a front wall 28 disposed between a front face 29 and an inner wall surface 30 and a rearwardly extending sleeve 32. A rear portion 33 of the sleeve 32 has internal threads 34 adapted to engage the threaded portion 22 of the nose bushing portion 16 of the body 19. Forwardly of the internal threads 34, inside the sleeve 32 of the nozzle cap 12 is a cylindrical cavity 36. Extending rearwardly from a back side 38 of the front wall 28 is a short annular formation 40 having an outer annular surface 42, a forward inner annular surface 44 and a rearward inner, flared, or frusto-conical surface 45.

Figure 1A:
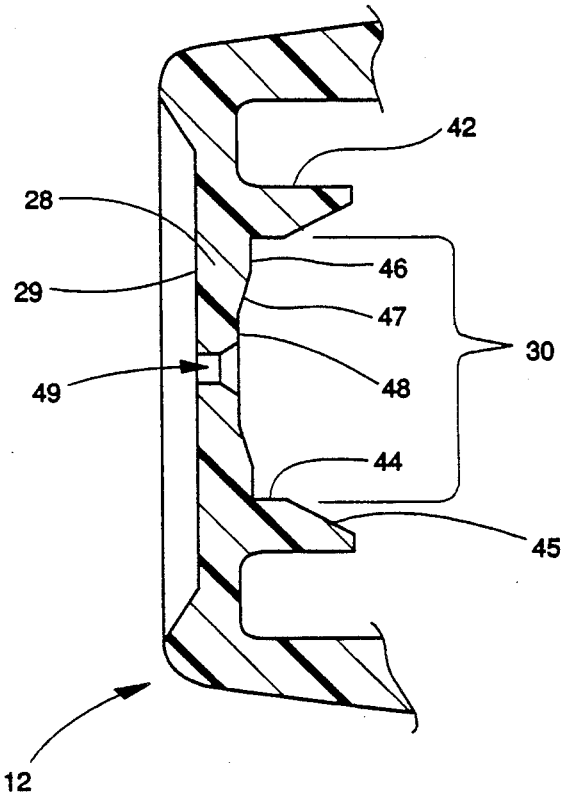
FIG. 1A is an enlarged, fragmentary vertical sectional view of the nozzle cap of the assembly shown in FIG. 1, and shows an inner wall sealing surface of the nozzle cap.

As best shown in FIG. 1A, the forward inner annular surface 44 extends to the inner wall surface 30 which includes an annular planar rearwardly facing surface 46, a slightly inclined or frusto-conical surface 47 and a central planar surface 48.

The front wall 28 has an outlet orifice 49 extending therethrough in the center thereof between the central planar surface 48 and the front face 29.

Figure 2:
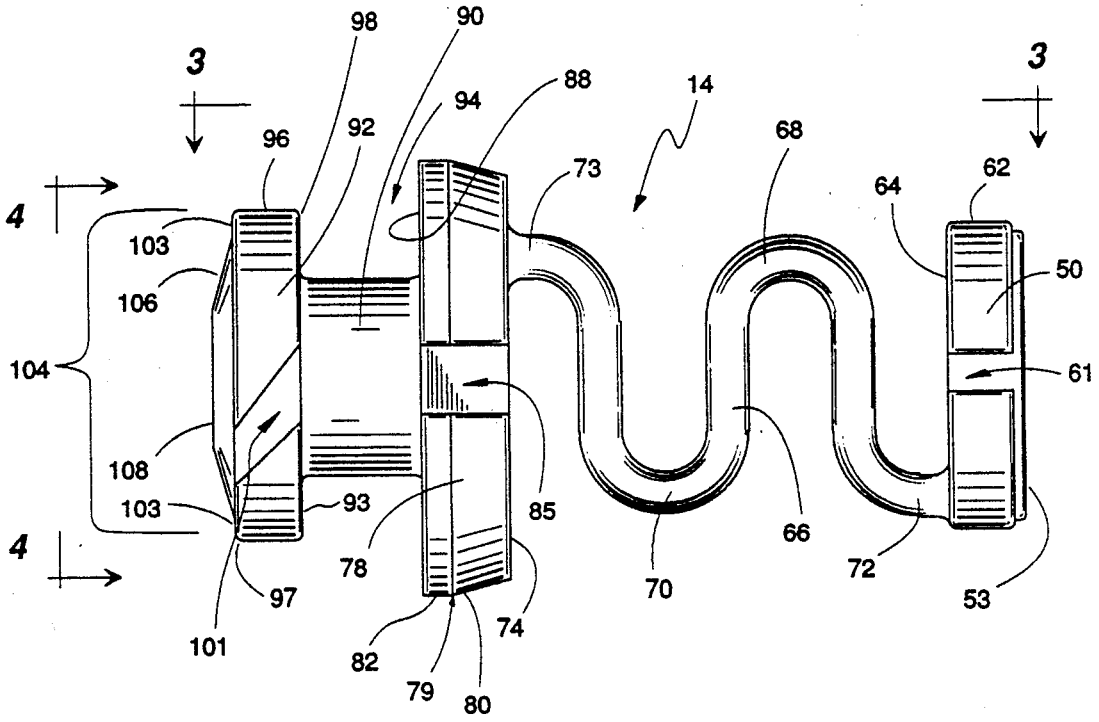
FIG. 2 is a side elevational view of the spring valve of the assembly shown in FIG. 1.
Figure 3:
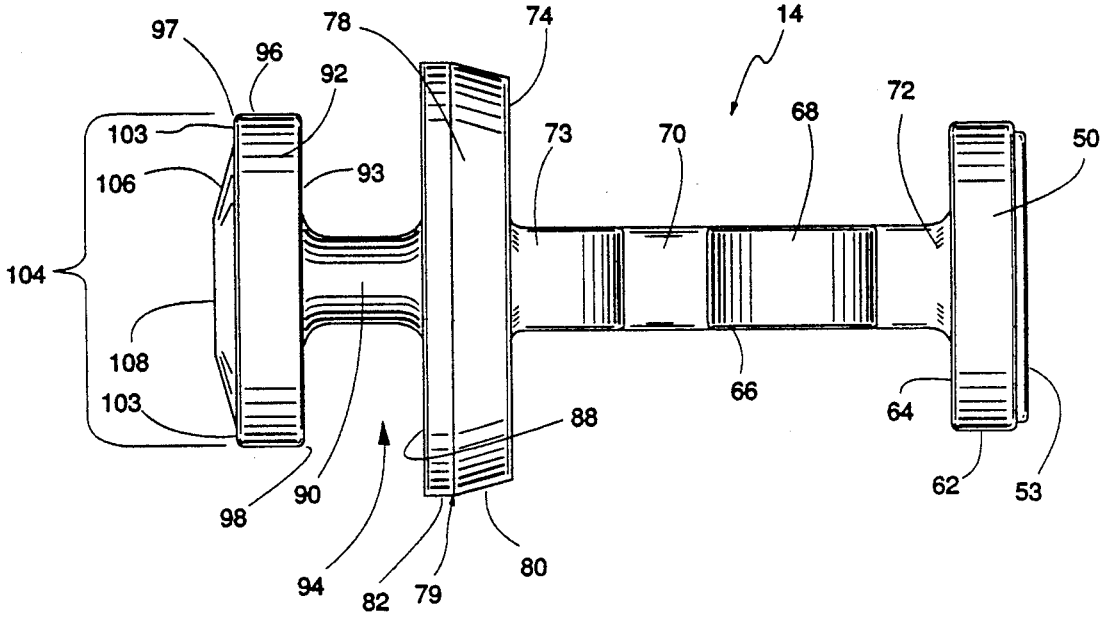
FIG. 3 is a top plan view of the spring valve shown in FIG. 2 and is taken along line 3—3 of FIG. 2.
Figure 4:
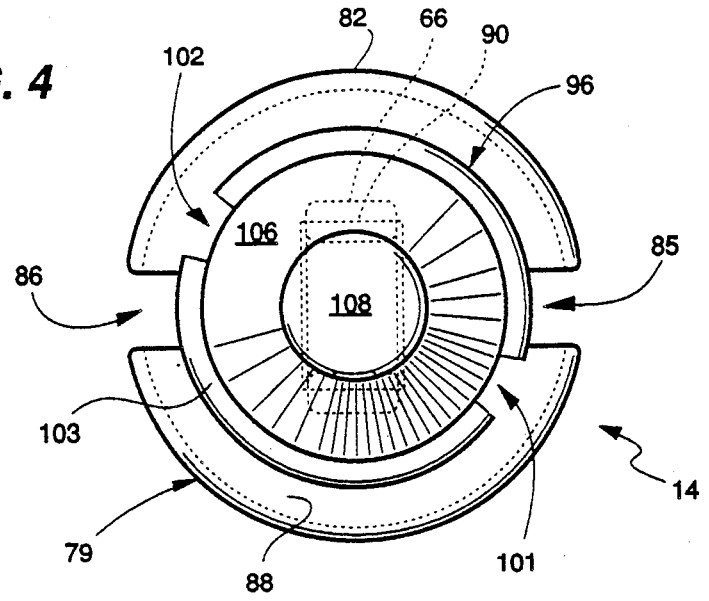
FIG. 4 is a front elevational view of the spring valve shown in FIGS. 1, 2 and 3 and is taken along line 4—4 of FIG. 2.

Referring now to FIGS. 2–4 there is illustrated therein the spring valve 14 of the assembly 10 (FIG. 1). The spring valve 14 includes a disc shaped valve member 50 having a rearwardly facing surface 53 and two flow-through slots 61 in an outer periphery 62 thereof providing liquid passage means for the forward flow of liquid when the raised planar valve seating surface 53 is unseated.

Integral with and extending forwardly from a forwardly facing front side surface 64 of the disc shaped valve member 50 is a sinuous spring 66 which, in the illustrated embodiment, has two loops 68, 70, or stated another way, extends through one and one half cycles when comparing the sinuous spring 66 to a sine wave.

The sinuous spring 66 is fixed at the rear end 72 to (integral with) the forwardly facing front side surface 64 at a location adjacent the outer periphery 62 of the disc shaped valve member 50 and, if desired, it can be fixed to (integral with) the center of the forwardly facing front side surface 64. As shown in FIG. 3, the sinuous spring 66 is like a leaf spring or wave plate spring.

A front end 73 of the sinuous spring 66 is fixed to a back side surface 74 of a generally cylindrical mid-spring valve base portion 78 of the spring valve 14 adjacent an outer periphery 79 of the mid-spring valve base portion 78. The mid-spring valve base portion 78 has on its outer periphery 79 an inclined frusto-conical surface 80 and an annular surface 82. Again, if desired, the front end 73 can be fixed to (integral with) the center of the back side surface 74.

The mid-spring valve base portion 78 has two (or more, e.g., four, if desired) flow-through slots 85, 86 (FIG. 4) in the outer periphery 79.

Extending centrally from a front surface 88 of the mid-spring valve base portion 78 is a rectangular in cross-section stem portion 90 and integral with (fixed to) the forward end of the stem portion 90 is a face disc 92. The space between a back side 93 of the face disc 92 and the front surface 88 of the mid-spring valve base portion 78 defines a generally annular space 94.

The face disc 92 has an outer annular periphery 96 with a front rounded annular corner 97 and a rear rounded annular corner 98. The outer annular periphery 96 also has two angularly extending diametrically opposed grooves 101, 102 (FIG. 4) which are tangential to a cylindrical envelope passing through the grooves 101, 102 (FIG. 4) and transverse or skew to an elongate axis of the spring valve 14. The grooves 101, 102 extend between the back side 93 and a forwardly facing planar annular surface 103 of the face disc 92. The front portion 104 includes the forwardly facing planar annular surface 103, a frusto-conical surface 106, and a central planar surface 108 and is adapted to mate with and seat against the inner wall surface 30 (FIG. 1A) of the nozzle cap (FIG. 1).

Figure 7:
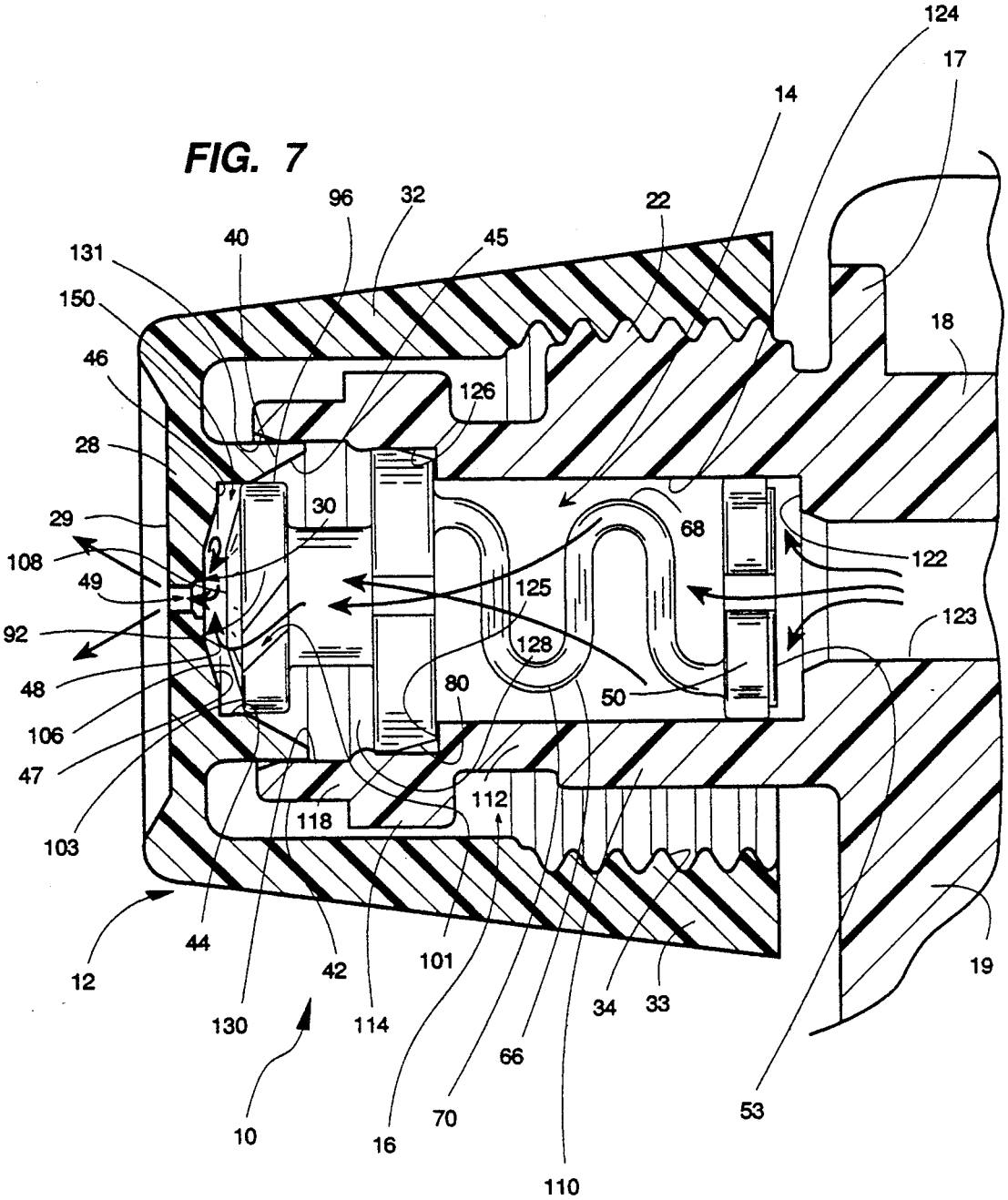
FIG. 7 is a sectional view, similar to FIG. 6, of the nozzle cap, spring valve and nose bushing portion of the body but showing the nozzle cap partially unthreaded from the body where the front seating surface of the spring valve face disc is unseated from the inner wall surface of the nozzle cap with the outer annular periphery of the face disc still sealingly engaging an inner annular surface in a short annular formation on the back side of a front wall of the nozzle cap to define a swirl chamber between an inner wall surface of the front wall of the nozzle cap, the inner annular wall surface of the short annular formation and the face disc whereby liquid is channeled through the angular grooves in the outer annular periphery of the face disc into the swirl chamber to provide a spray mode position of the nozzle cap, spring valve and body assembly where liquid is discharged in a generally conical spray pattern.

The angularly extending diametrically opposed grooves 101, 102 (FIG. 4) direct liquid into a space created between the front portion 104 of the face disc 92 and the inner wall surface 30 (FIG. 1A) of the nozzle cap 12 to create a swirl or circular flow of liquid in that space whereby liquid swirling in the space exits the outlet orifice 49 (FIG. 7) in a conical spray pattern when the assembly 10 is in the spray mode as shown in FIG. 7.

Figure 5:
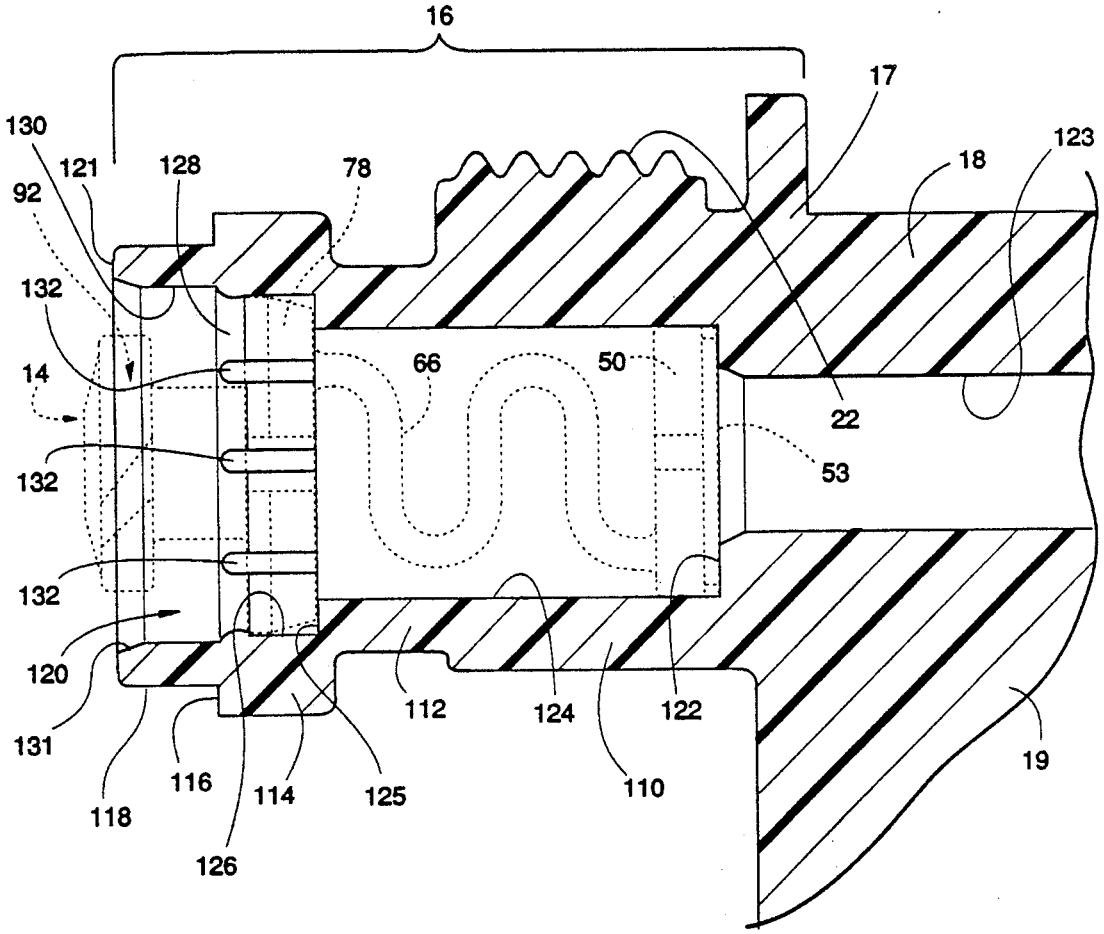
FIG. 5 is an enlarged vertical sectional view of the nose bushing portion of the body, similar to the view shown in FIG. 1 but with the nozzle cap removed.

The nose bushing portion 16 of the body 19 is best shown in FIG. 5 and is shown with the base portion 17 integral with the front end 18 of the body 19 of the trigger sprayer 20 (FIG. 1). It is to be understood that the nose bushing portion 16 of the body 19 can be a separate unit which is press fitted into (or otherwise fixed in ) the body 19 of the trigger sprayer 20 (FIG. 1).

The nose bushing portion 16 of the body 19 includes a forwardly extending, generally cylindrical projection 110 which has the partially cylindrical threaded portion 22, a lower section of which is cut away and unthreaded as shown. Forward of the threaded portion 22 is a reduced-in-diameter portion 112, a larger-in-diameter annular ring portion 114, a forward facing shoulder 116 and a smaller-in-diameter outer annular surface 118.

The forwardly extending generally cylindrical projection 110 has a stepped cylindrical cavity 120 therein which extends inwardly from an outer end 121 of the projection 110 into the generally cylindrical projection 110 to an inner back wall 122 of the stepped cylindrical cavity 120. A passageway 123 opens onto and extends from the inner back wall 122 through the base portion 17 into the front end 18 of the body 19 and communicates with a pumping system (not shown), which can be of conventional design, in the trigger sprayer 20 (FIG. 1). The annular axially facing area of the inner back wall 122 around the passageway 123 defines a valve seat which mates with the raised planar valve seating surface 53 (FIG. 3) of the spring valve 14 (FIG. 3).

The stepped cylindrical cavity 120 includes an inner cylindrical cavity 124 extending forwardly from the inner back wall 122 to a forwardly facing annular shoulder 125 which extends outwardly to a first inner annular surface 126 which extends forwardly to an annular rib 128 that extends radially inwardly from the first inner annular surface 126, forwardly and then radially outwardly to a second inner annular surface 130 of slightly larger diameter than the diameter of said first inner annular surface 126. At the forward end of the second inner annular surface 130 is an outwardly inclined, beveled or frusto-conical surface 131.

Circumferentially spaced apart, axially extending ribs or slots 132 can be provided on or in the first inner annular surface 126 extending forwardly onto or into the annular rib 128 to assist in holding the mid-spring valve base portion 78 of the spring valve 14 in the stepped cylindrical cavity 120.

In assembling the assembly 10 (FIG. 1), the spring valve 14 is inserted in the inner cylindrical cavity 124 placing the raised planar valve seating surface 53 against the valve seat forming inner back wall 122. Then the mid-spring valve base portion 78 is forced over the annular rib 128 and against the forwardly facing annular shoulder 125 compressing the sinuous spring 66 and locking the mid-spring valve base portion 78 against the shoulder 125 and the first inner annular surface 126.

Figure 6:
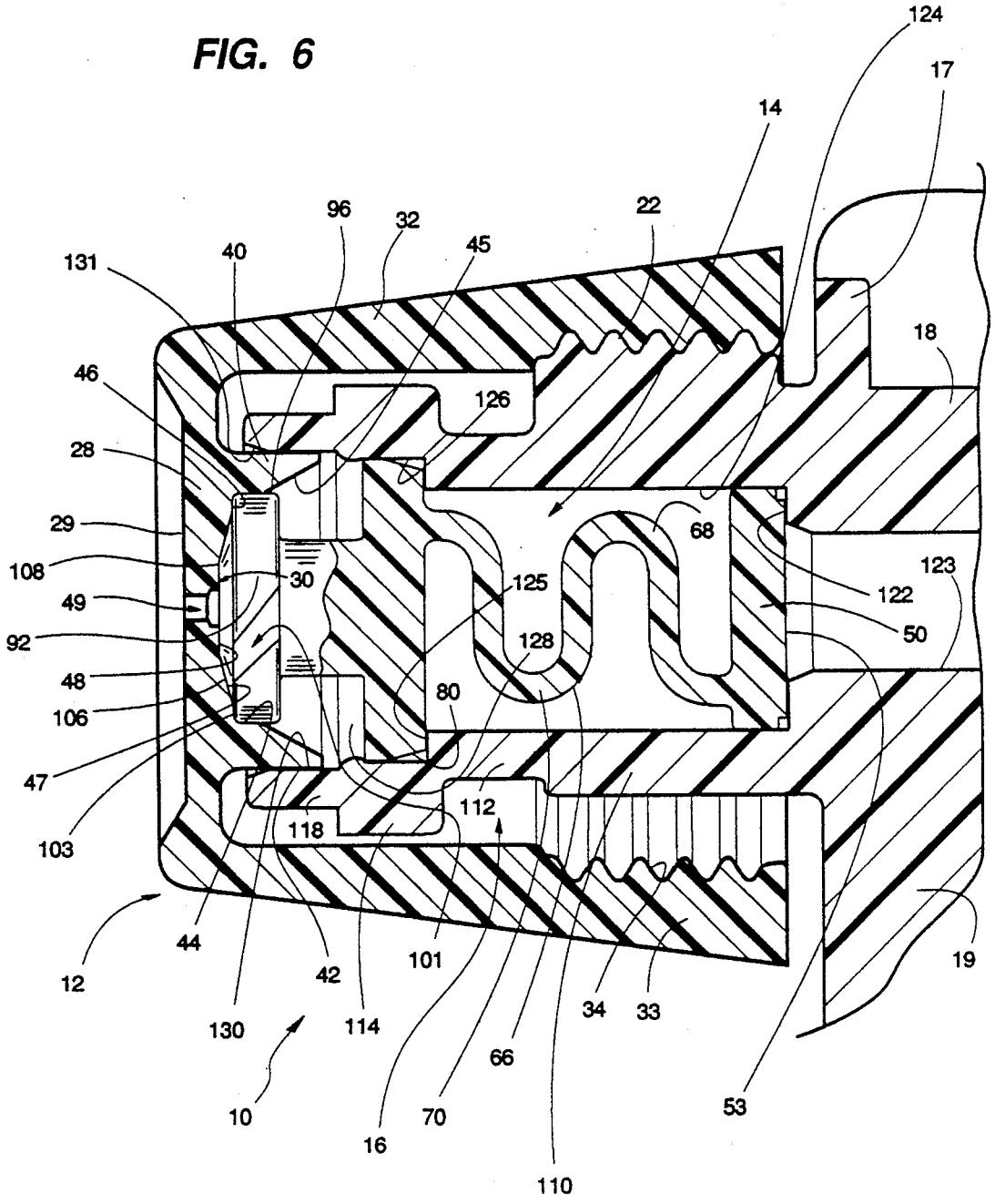
FIG. 6 is a vertical sectional view of the nozzle cap, spring valve and nose bushing portion of the body of the trigger sprayer shown in FIG. 1 with the nozzle cap fully threaded onto the body and shows the front seating surface of the spring valve face disc fully seated against an inner wall surface in the nozzle cap to provide an OFF mode position for the containment of a liquid.

As best shown in FIG. 2, the inclined frusto-conical surface 80 on the outer periphery 79 of the base portion 78 of the spring valve 14 facilitates this insertion. As shown in FIG. 6, the nozzle cap 12 is then threaded onto the nose bushing portion 16 of the body 19 to the fully closed or OFF position. The rearward inner flared or frusto-conical surface 45 on the short annular formation 40 in the nozzle cap 12 and the front rounded annular corner 97 (FIG. 3) of the face disc 92 facilitate movement of the face disc 92 of the spring valve 14 into position against the forward inner annular surface 44 of the short annular formation 40 and the inner wall surface 30 of the nozzle cap 12.

Figure 8:
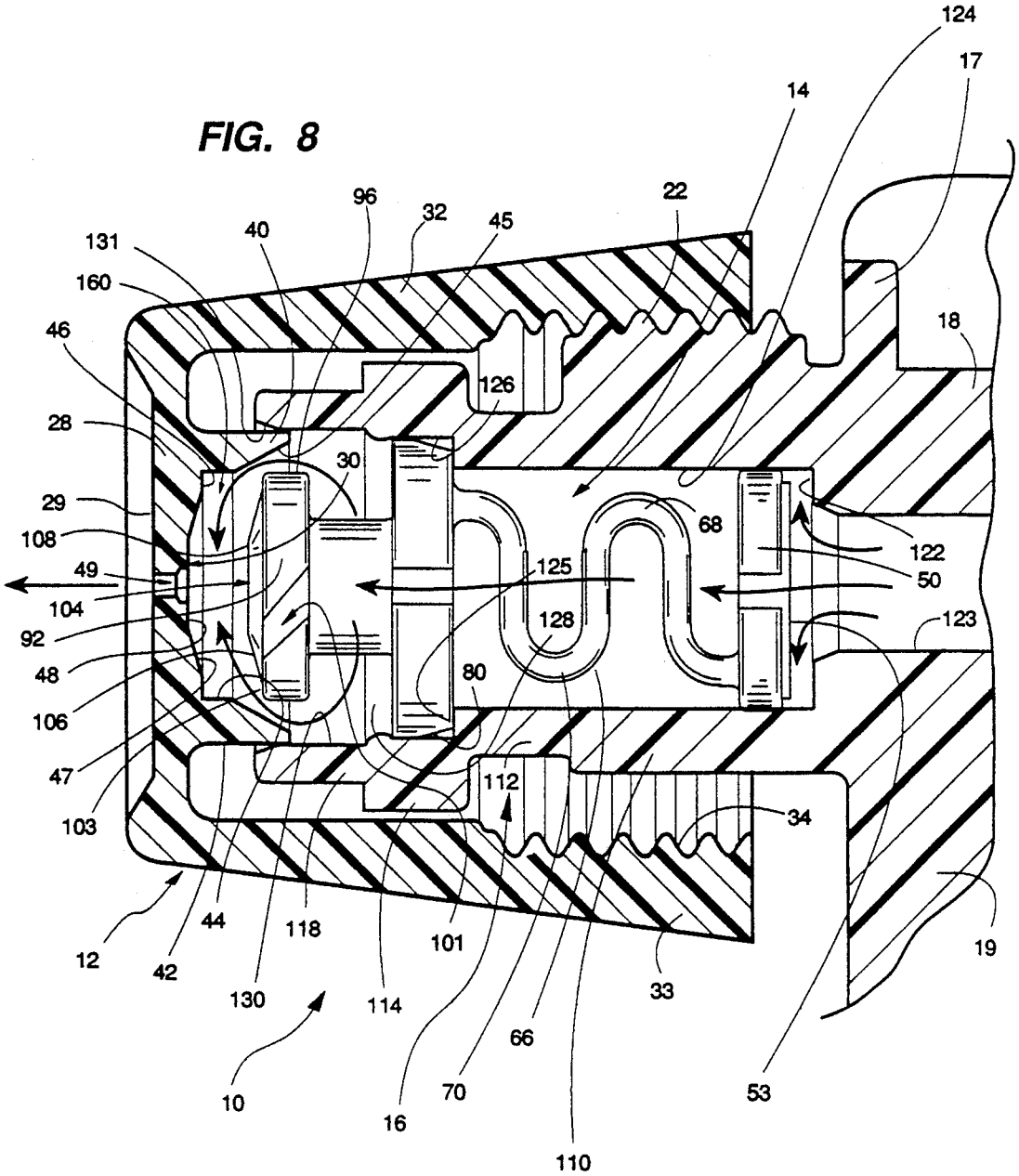
FIG. 8 is a sectional view, similar to FIG. 7, of the nozzle cap, spring valve and nose bushing portion of the body, but showing the nozzle cap further unthreaded from the body to space the inner wall surface of the nozzle cap further from the front portion of the spring valve face disc to form a larger chamber and to disengage the outer annular periphery of the face disc from the inner annular wall surface of the nozzle cap to allow liquid to flow over the outer annular periphery of the face disc without any specified direction into the larger chamber to provide a stream or jet position wherein liquid is discharged in a stream or jet pattern.

In FIGS. 6, 7, 8 there is illustrated, respectively, the OFF mode, spray mode, and stream mode positions of the nozzle cap, spring valve and body of the assembly 10.

In FIG. 6 there is shown the OFF mode position of the nozzle cap 12, spring valve 14 and nose bushing portion 16 of the body 19 of the assembly 10. In this mode, the nozzle cap 12 is screwed upon the externally threaded portion 22 of the body 19. In this OFF mode, the outer annular periphery 96 of the face disc 92 is in flush sealing contact with the forward inner annular surface 44 in the nozzle cap 12. Also, the front portion 104 (FIG. 3) is in flush sealing contact with the inner wall surface 30 of the nozzle cap 12.

The spray mode position of the adjustable nozzle cap 12, spring valve 14 and nose bushing portion 16 of the body 19 of the assembly 10 is illustrated in FIG. 7. In FIG. 7, the rotatable nozzle cap 12 has been rotated outwardly off the threaded portion 22 of the body 19 a sufficient distance to a second position where the inner wall surface 30 of the nozzle cap 12 is moved forward from the front portion 104 (FIG. 3) of the face disc 92 of the spring valve 14 to an unseated position. This unseated position defines a swirl chamber 150 between the front portion 104 (FIG. 3) of the face disc 92 and the inner wall surface 30 of the nozzle cap 12 and permits pumped, pressurized liquid, which forces the raised planar valve seating surface 53 off the valve seat forming inner back wall 122, into the inner cylindrical cavity 124 through the two flow-through slots 61 (FIG. 2) in the outer periphery 62 (FIG. 2) and slots 85, 86 (FIG. 4) in the mid-spring valve base portion 78 (FIG. 3) to flow to and through the angularly extending diametrically opposed grooves 101 and 102 (FIG. 4) into the swirl chamber 150 in a circular or spinning motion for discharge through the outlet orifice 49 in the front wall 28 of the nozzle cap 12 in a conical spray pattern. The swirl chamber 150 is defined between the forward inner annular surface 44, the front portion 104 (FIG. 3) of the face disc 92 and the inner wall surface 30 of the nozzle cap 12.

In this respect, note that the outer annular periphery 96 of the face disc 92 is still in sealing engagement with the forward inner annular surface 44 whereby liquid flow is constrained to flow, or is channeled through the angularly extending diametrically opposed grooves 101 and 102 (FIG. 4) to create a swirl flow in the swirl chamber 150. The conical spray mode of operation of the nozzle cap 12, spring valve 14 and body 19 of the assembly 10 is characterized by the unseating of the front portion 104 (FIG. 3) of the spring valve 14 from the inner wall surface 30 of the nozzle cap 12, but, with the outer annular periphery 96 of the face disc 92 remaining in flush contact with the forward inner annular surface 44 in the short annular formation 40 in the nozzle cap 12, so as to not permit liquid to move over or around the face disc 92 into the swirl chamber 150 but to only permit liquid to flow through the angularly extending diametrically opposed grooves 101, 102 (FIG. 4) into the swirl chamber 150 in a circular or spinning motion for discharge out of the outlet orifice 49 of the nozzle cap 12 in a conical spray pattern.

In FIG. 8 there is illustrated a stream or jet mode position of the nozzle cap 12, spring valve 14 and nose bushing portion 16 of the body 19 of the assembly 10 where the nozzle cap 12 is unthreaded further outwardly from the nose bushing portion 16 of the body 19 to create a larger chamber 160. The outer annular periphery 96 of the face disc 92 now is located opposite and spaced from the rearward inner flared or frusto-conical surface 45 of the short annular formation 40. Note, however, that the outer annular surface 42 on the short annular formation 40 is still in flush contact with the second inner annular surface 130 so that no liquid leaks out of the nozzle cap 12. Also, if desired, the nozzle cap 12 and the nose bushing portion 16 of the body 19 can be provided with cooperating stop means which prevent the nozzle cap 12 from being unthreaded further off the nose bushing portion 16 of the body 19 from the position thereof shown in FIG. 8. The discharge of liquid in this mode will be a stream or jet pattern due to the fact that liquid from the passageway 123 can now pass over and around the outer annular periphery 96 of the face disc 92 and is not constrained to flow through the angularly extending diametrically opposed grooves 101, 102 (FIG. 4) for entry into the larger chamber 160 for discharge out of the outlet orifice 49 of the nozzle cap 12. As a result, the liquid flow is not directed or channeled and the non-specific liquid flow is basically radially inwardly to the outlet orifice 49 and not in a swirl. This results in a stream discharge from the outlet orifice 49.

It is believed that the nozzle cap 12, spring valve 14 and body 19 of the assembly 10 of the present invention and its numerous attendant advantages will be fully understood from the foregoing description, and that changes may be made in form, construction, and arrangement of the several parts thereof without departing from the spirit or scope of the invention, or sacrificing any of the advantages of the assembly 10. The structure herein disclosed is a preferred embodiment for the purpose of illustrating the invention. Accordingly, the scope of the invention is only to be limited as necessitated by the accompanying claims.

We claim:

1. A nozzle cap, spring valve and body assembly comprising:

a nose bushing portion of the body which is adapted to be mounted to, or integral with a dispensing end of a liquid dispenser, which has an outer threaded portion and which has a cavity therein opening onto a front end of said nose bushing portion of the body, a spring valve received in said cavity, and a cup shaped nozzle cap which has a front wall with an outlet orifice therein and a rearwardly extending generally cylindrical sleeve, said sleeve having internal threads therein for threadably mounting said cap on said threaded portion of said nose bushing portion of the body, said spring valve including a front face disc having a front face, an outer annular periphery and two circumferentially spaced apart angular, spin causing grooves in said annular periphery, means coupled to said face disc for mounting said spring valve in said cavity, a sinuous spring which is received in said cavity and which extends rearwardly from said mounting means, and a movable valve seat at the rear end of said spring;

said nose bushing portion of the body having passage means communicating at one end with liquid outlet means in the liquid dispensing device and at another end with said cavity and having a stationary valve seat in said cavity on which said movable valve seat is seated;

and said nozzle cap having specially contoured surfaces on the back side of said front wall including an inner wall surface within said nozzle cap constructed and configured to cooperate with and mate with portions of said face disc;

said nozzle cap being rotatable and axially moveable relative to said nose bushing portion of the body between three positions, the first position being defined by the nozzle cap being threaded onto said nose bushing portion of the body to a point where portions of said front face and said annular periphery of said face disc mate with portions of said specially configured surfaces of said nozzle cap to close off and seal said outlet orifice, the second position being defined by said nozzle cap being partially unthreaded from said nose bushing portion of the body to unseat said front face of said face disc from said inner wall surface but with said annular periphery still in sealing engagement with a portion of said specially contoured surface within said nozzle cap so that a swirl chamber is established between said inner wall surface and said front face of said face disc and so that liquid pumped past said movable valve seat is channeled through said two angular spin causing grooves to travel in a swirl in said swirl chamber and exit said outlet orifice in a conical spray pattern, and said third position being defined by a further partially unthreaded position of said nozzle cap off of said nose bushing portion of the body where said face disc is completely unseated from said specially contoured surface within said nozzle cap so that liquid can now flow over said outer annular periphery of said face disc and radially inwardly to and out said outlet orifice in a stream pattern.

2. The nozzle cap, spring valve and body assembly of claim 1 wherein said inner wall surface of said nozzle cap is partially frusto-conical and partially planar and said front face of said face disc is partially frusto-conical and partly planar to mate with and sealingly engage with said inner wall surface.

3. The nozzle cap, spring valve and body assembly of claim 1 wherein said specially contoured surface within said nozzle cap includes a short annular formation having an outer annular surface, an inner annular surface which sealingly engages with said outer annular periphery of said face disc and an inner larger in cross-sectional surface which does not engage said outer annular periphery of said face disc.

4. The nozzle cap, spring valve and body assembly of claim 1 wherein said cavity in said nose bushing portion of the body includes a stepped annular surface including an inner cylindrical cavity in which said sinuous spring is received.

5. The nozzle cap, spring valve and body assembly of claim 4 wherein said stepped surfaces are defined by an axially facing, planar, annular shoulder against which said mounting means is received and an annular rib is provided forwardly of said shoulder past which rib said mounting is pushed to fix said mounting means against said annular shoulder.

6. The nozzle cap, spring valve and body assembly of claim 5 wherein said mounting means include a generally cylindrical, disc shaped, mid-spring valve base portion having flow-through means therein.

7. The nozzle cap, spring valve and body assembly of claim 6 wherein said flow-through means include two axially extending slots in the periphery of said mid-spring valve base portion.

8. The nozzle cap, spring valve and body assembly of claim 4 wherein said specially contoured surface within said nozzle cap includes a short annular formation having an outer annular surface, an inner annular surface which sealingly engages with said outer annular periphery of said face disc and an inner larger in cross-sectional surface which does not engage said outer annular periphery of said face disc and wherein said stepped surfaces include a forward annular surface which sealingly engages said outer annular surface of said short annular formation.

9. The nozzle cap, spring valve and body assembly of claim 1 wherein said nozzle cap and said spring valve are made of different thermoplastic materials.

10. The nozzle cap, spring valve and body assembly of claim 1 wherein said outlet orifice is centrally located relative to said nozzle cap front face.

11. The nozzle cap, spring valve and body assembly of claim 1 wherein said movable valve seat has flow-through means for allowing liquid to flow forwardly past said movable valve seat in said cavity when said movable valve seat is unseated by liquid pressure.

* * * * *